United States Patent [19]

Pettersen et al.

[11] 3,949,906

[45] Apr. 13, 1976

[54] LIQUID DISPENSING PUMP SELECTIVELY SEALABLE AGAINST LEAKAGE

[75] Inventors: Edward A. Pettersen, Waterbury; Paul M. Kotuby, Naugatuck, both of Conn.

[73] Assignee: The Risdon Manufacturing Company, Naugatuck, Conn.

[22] Filed: Mar. 19, 1975

[21] Appl. No.: 559,894

[52] U.S. Cl. ..... 222/153; 222/321; 222/384; 239/333

[51] Int. Cl.[2] ..... B67D 5/32

[58] Field of Search ..... 222/153, 320, 321, 341, 222/383, 384, 402.11; 239/333; 417/459, 549, 553

[56] References Cited

UNITED STATES PATENTS

| | | | |
|---|---|---|---|
| 3,239,151 | 3/1966 | Jokelson | 239/333 |
| 3,362,344 | 1/1968 | Duda | 222/321 X |
| 3,531,224 | 9/1970 | Clevenger et al. | 222/321 X |
| 3,627,206 | 12/1971 | Boris | 222/321 X |

*Primary Examiner*—Robert B. Reeves
*Assistant Examiner*—Charles A. Marmor
*Attorney, Agent, or Firm*—St. Onge Mayers Steward & Reens

[57] ABSTRACT

The disclosed device is a finger operated plunger pump which is mountable in the mouth of a hand-held container for liquid products to provide an unpressurized dispenser package for consumer use. The pump includes the usual pump cylinder, plunger, discharge nozzle, check valves and cap for mounting the pump on the container, and is characterized by provision of a lockable seal for the discharge passage, the seal being selectively operable by the user to disable the pump and simultaneously seal it against leakage. The disablement of the pump is effected by limited rotation of one seal member relative to its complementary member to shift them between seated and unseated positions, such rotation being effected by turning the pump plunger relative to its cylinder through a connection including a telescoping stem which accommodates normal plunger reciprocation.

8 Claims, 8 Drawing Figures

LIQUID DISPENSING PUMP SELECTIVELY SEALABLE AGAINST LEAKAGE

BACKGROUND OF THE INVENTION

1. Field of the Invention

The present invention relates to a liquid dispensing pump which is finger-operated to dispense the liquid contents of a hand-held, non-pressurized container. These pumps are commonly used to dispense liquids such as window and all-purpose cleaners, insecticides and other household products; also hair sprays, deodorants, colognes and similar personal products from a consumer type dispensing package in which the pump also serves to close the container during shipment or other periods of non-use.

2. Description of the Prior Art

Finger-operated dispensing pumps for discharging consumer-type liquid products from a hand-held container are well known and are used extensively in "convenience" packaging to facilitate the user's dispensing of the product from the container. Such pumps are commonly designed to be thrown away with the container when this becomes empty. The cost of the pump is therefore an important consideration, so that simplicity and economy in design, materials, manufacture and assembly are critical to a commercially satisfactory pump. In addition to their dispensing function, these pumps must also serve as closures for the associated containers when not in use. Accordingly they must provide assured sealing capability for the container to prevent leakage regardless of inversion of the package during shipping and related handling, or in case of accidental upsetting or dropping by the user. The conflicting requirements of low cost yet assurred operativeness and security against leaking have presented a challenge which has generated many pump designs, of which those shown in U.S. Pat. Nos. 3,228,570, 3,248,021, 3,394,836, 3,583,605, 3,797,705, Re. 28,366 are representative.

SUMMARY OF THE INVENTION

In a preferred embodiment of the present invention, to be described below in detail, the liquid dispensing pump includes a lockable plunger seal which is manually operated by the user to provide against unauthorized use or accidental leakage during period of non-use. This pump includes a body or housing which defines at its interior a cylindrical pump or product receiving chamber having an inlet adjacent one end which communicates that chamber with liquid product in the container. A hollow plunger assembly is axially received in the other end of the pump chamber, this assembly including a cylindrical piston, and a piston rod connected to the piston and projecting out of the pump chamber. The piston makes a sliding fit in the chamber to provide pumping action when reciprocated, such reciprocation being effected by finger actuation of a projecting end of the piston rod. Preferably the plunger assembly is spring biased axially outwardly of the pump chamber, but is prevented from totally escaping by abutment against a closure assembly including a cap secured to the pump body and apertured to receive the projecting piston rod. This cap serves also as a means for mounting the pump in the mouth of a container in order to close the latter and normally retain the liquid contents. An outlet duct passes generally axially through the pump plunger to communicate with atmosphere by way of a discharge orifice disposed in an actuator button or nozzle attached to the outer end of the piston rod. Check valves disposed in the inlet and outlet passage of the pump operate in the usual manner to prevent reverse flow of the liquid product during reciprocating cycles of the plunger.

The arrangement used for manually disabling pump operation comprises a plunger seal assembly positioned in the pump chamber, and cooperating with flow passages of that chamber, wherein cooperating seal members may be selectively set to alternative positions, one of which (i.e., open position) allows the passage of liquid to take place through the pump, while in the other (i.e., closed) position flow is positively blocked. In the preferred construction, the shut-off or sealing point is located at the entrance to the outlet duct in the plunger, but it can also be located at the pump chamber inlet. In either event, the plunger seal is controlled by relative rotational movement of complementary valve and seat members comprising the seal assembly, one of which is fixed to the pump cylinder and the other to the plunger. Registrable detent means on respective confronting faces of the valve and seat members effect both a restraining and a camming action, the latter producing axial separation of those faces when the detent means is rotated out of registration by rotating the cylinder relative to the plunger. This unlocks the seal and opens the plunger discharge duct to allow passage of fluid. Provision is made in the seal assembly to accommodate the normal reciprocation of the plunger. This is arranged by providing a telescoping stem to support a sealing member in the pump chamber. Provision is made on the stem end distal to the sealing member for non-rotative attachment of the assembly to either the pump housing or plunger.

The general design of the pump and the specific configuration of the components is eminently suited to manufacture by injection molding techniques using various commercially available plastic materials, the molding dies needed being simpler and less expensive to make and use than those of other available pumps affording similar functional cabability. Less plastic, higher production rates, and greater adaptability to automated assembly are further advantages which lead to lower cost, all without sacrifice of functional reliability. The design further enables pump manufacturer to easily change the pumping capacity in a run of units being produced, in order to adapt a basic pump design for different customer requirements, without change in the molding dies.

Other objects, aspects and advantages of the present invention will be pointed out in or will be understood from the detailed description of the preferred embodiments provided below, considered together with the following drawings.

DETAILED DESCRIPTION OF THE PREFERRED EMBODIMENTS

Figure 1:
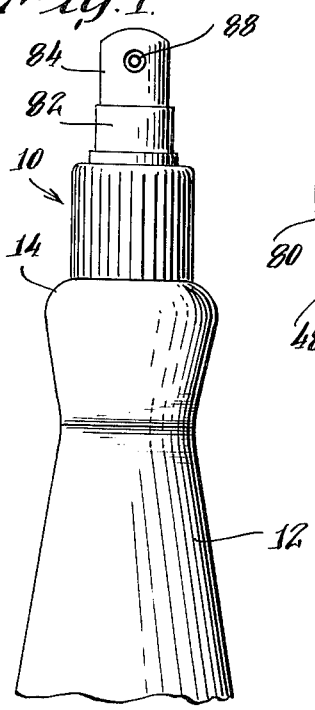
FIG. 1 is a side view of the liquid dispenser pump of the present invention installed on a container.
Figure 2:
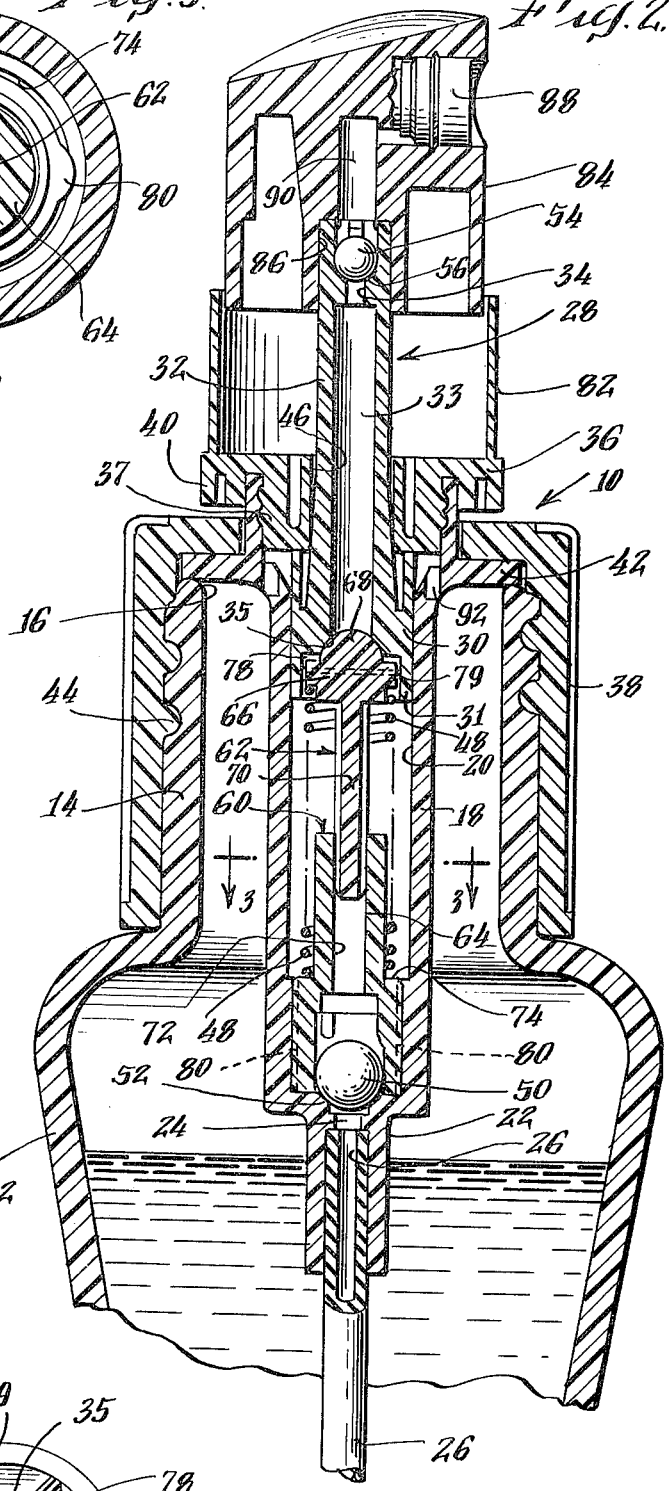
FIG. 2 is an enlarged vertical cross sectional view of a preferred embodiment of the dispensing pump, showing the pump seal in closed position.

A liquid dispensing pump embodying the present invention is illustrated in FIGS. 1 and 2. The pump itself is indicated generally at 10, and is shown mounted on a container 12 which has a threaded neck 14 that defines a mouth 16 in which the pump is received to form a closure for the container. The container may be of any suitable material, such as glass or plastic, adapted to hold the liquid consumer product.

Referring more particularly to FIG. 2, dispensing pump 10 includes a hollow cylindrical housing or body 18 whose inner surface defines a pump chamber 20 into which product to be dispensed is drawn by actuation of the pump, and from which it is discharged to atmosphere by such action. Pump housing 18 is closed at its lower end but is formed thereat to provide a projecting hollow tailpiece 22 having an inlet passage 24 which communicates pump chamber 20 with the interior of the container. A dip tube 26 is received in tailpiece 22 and extends downwardly to the bottom of the container for induction of fluid into the pump chamber.

A plunger assembly 28, comprising a piston 30 having a hollow cylindrical skirt 31 and a projecting hollow piston rod 32, is mounted for reciprocable movement to and from a depressed position in pump chamber 20, and also for rotation relative to body 18 forming the chamber. Skirt 31 makes a sliding seal with the wall of the pump chamber to effect pumping action when the plunger is reciprocated. Piston rod 32 takes the form of a tubular duct 33 which communicates at its outer end with atmosphere by way of outlet passage 34, and at its inner end with the pump chamber by way of port 35 opening into the underface of the piston within skirt 31.

The upper end of pump body 18 is open to receive the plunger assembly, and a closure is provided to retain the plunger in operative relation to the cylinder. This closure consists of a flanged collar or retainer 36, and a plastic or metal gland nut or cap 38. Retainer 36 has an axially protruding cylindrical boss 37 on its under face which is received in and closes the open upper end of housing 18. The engaged surfaces of housing 18 and retainer 36 are configured to form an interlocking snap fit for securing the retainer to the housing. The periphery of retainer 36 forms a shoulder 40 which overlies in axially spaced relation a complementary peripheral flange 42 formed on housing 18. Cap 38 is centrally apertured in its top and is received over the upper end of housing 18 to be trapped thereon between shoulder 40 and flange 42, permitting rotation relative to the pump housing. The interior of the cap skirt is typically provided with molded threads 44 by which the cap and the pump assembly is screwed to the neck of the container to clamp housing flange 42 against the upper lip of the container mouth. Obviously other methods of attachment, such as crimping of the skirt of the cap circumferentially about an exterenal bead on the neck of a container, could be substituted.

Boss 37 of retainer 36 is apertured at 46 to allow projection therethrough of plunger rod 32. The plunger is normally biased to extended position relative to housing 18 by a compression spring 48, through means disclosed more fully hereinafter, to cause abutment of the upward extension of piston skirt 31 against the underface of boss 37. Such abutment serves as a peripheral seal about aperture 46 in the boss when the plunger is in extended position which helps to prevent leakage of the fluid contents between the piston rod and aperture wall in case of inversion of the package. It is preferred, however, to provide a more positive fluid seal at this point by a tapered enlargement of the inner end of piston rod 32 in slightly frustoconical fashion, so that as the plunger moves to its extended position, this portion of the piston rod becomes wedged in aperture 46.

Pump 10 is provided with the usual inlet and outlet check valves which comprise, respectively, a ball 50 and cooperating seat 52 at the housing inlet, and a ball 54 and cooperating seat 56 located at the outlet side of conduit 34 in the plunger assembly. Reciprocation of plunger 28 pumps fluid into chamber 20 and out through piston rod 32 in normal fashion with the assistance of the check valves in preventing return flow during the pumping cycle.

The means employed for selectively conditioning the pump to allow normal pumping and product discharge to occur, or alternatively to prevent this and to prevent leakage through the plunger assembly due to accidental inversion of the package, will now be described in detail.

Figure 3:
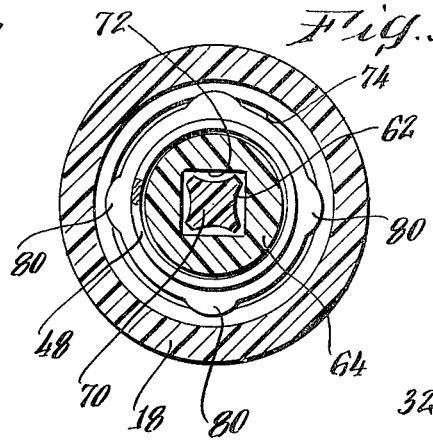
FIG. 3 is a cross sectional view taken on plane 3—3 in FIG. 2.
Figure 4:
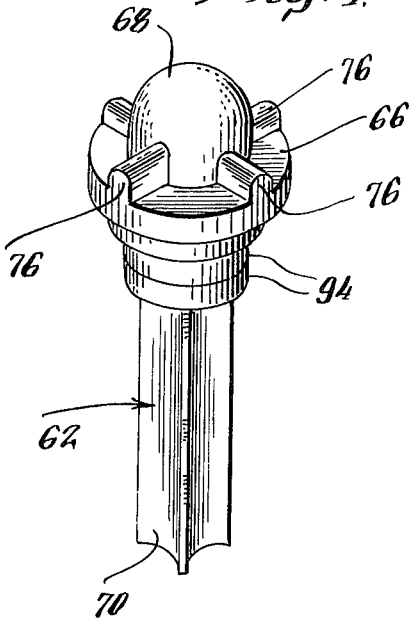
FIG. 4 is a perspective view of part of the plunger seal assembly.
Figure 5:
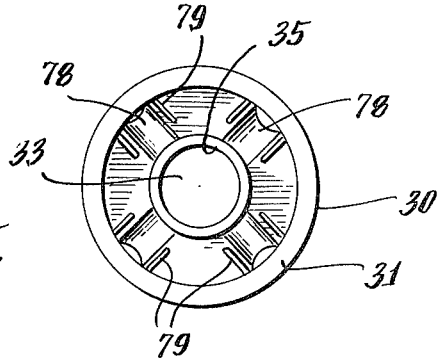
FIG. 5 is a plan view of the under face of the pump piston.

A plunger seal assembly 60 is inserted in pump chamber 20 to provide means for manually opening or closing port 35 of piston 30. The assembly comprises a stopper 62, shown more particularly in FIG. 4, and a base 64 in which the stopper is supported. The stopper comprises a circular disc 66 having a dome-like protuberance 68 on one face and an oppositely projecting stem 70 on the other face. Stem 70 is telescopically received in socket 72 of base member 64, the socket and stem being configured to permit freedom of axial telescoping movement between the stopper and base, while substantially preventing any relative rotational movement between them. To this end socket 72 and stem 70 in the specifically illustrated example are of generally square cross section, as seen more particularly in FIG. 3. As also seen in that figure, the faces of stem 70 may be cusped in order to provide increased flow areas between the confronting faces of the socket and stem, without destroying the relative non-rotational arrangement.

Stopper 62 is received within the depending portion of skirt 31 on piston 30, and dome 68 is seatable in port 35 to form a seal at that point. Stopper 62 is urged into this seated relation by compression spring 48. The spring is confined between the undersurface of disc 66 of the stopper and a shoulder 74 of base 64. Thus reaction of spring 48 through stopper 62 on plunger assembly 28 serves also to urge the plunger assembly to its extended position, as already described.

In seated condition, stopper 62 completely closes port 35 so that no fluid discharge can take place through the plunger. Manual disengagement of stopper 62 from its seated position is effected in the following manner. The upper surface of disc 66 of the stopper, surrounding dome 68, and the corresponding opposed undersurface of the piston 30 surrounding port 35, are formed with cooperating detent means which comprise a plurality of nibs 76 on disc 66 and respectively mating depressions 78 in the surface of the piston. In certain rotated positions, the nibs and depressions repectively register, which permits dome 68 to seat against the periphery of port 35 in the piston. By rotating stopper 62 relative to piston 30, the detent means are moved out of registration and, in so doing, effectively cam the stopper in an axial direction away from piston 30. See FIGS. 6 and 7. In this condition, dome 68 no longer can form a seal with port 35, and fluid may pass around the stopper and out through the hollow piston rod. Ridges 79 flanking depressions 78 in the piston face provide impediments to the inadvertent reregistration of nibs 76 in those depressions during pumping operation.

In order to effect the aforesaid relative rotation of stopper 62 and piston 30, stopper base 64 is securely fixed against rotation in chamber 20 of housing 18. This may conveniently be done by forming several short longitudinal ribs 80 axially along the lower end of base 64 to cause an interference fit of the base in housing 18 when these components are assembled. Due to self-accommodation of the parts through plastic flow, ribs 80 form corresponding depressions in the wall of housing 18 and thus effectively lock base 64 against rotation in the housing.

Retainer 36 is formed with an upstanding annular wall 82 forming a shroud within which an actuator button 84 is telescopically received. Button 84 is of generally typical spray nozzle configuration, having a socket 86 on its underface within which the upper end of piston rod 32 is received to form a fluid tight fit. Socket 86 communicates with a discharge nozzle 88 in the button through internal feed passages 90.

In order to permit venting of the interior of the container during pumping operation to dispense the product from a container to which the pump is attached, a vent port 92 is formed in the wall of pump housing 18, adjacent flange 42, which opens into the space above piston 30 in pump chamber 20. When plunger 28 is in fully extended position, vent 92 is cut-off from atmosphere by the wedge fit of piston rod 33 in aperture 46, or by abutment of piston skirt 31 against boss 37. But when the plunger is depressed, atmospheric communication through vent 92 to the interior of container 12 is effected around the periphery of the piston rod in retainer 36.

Figure 6:
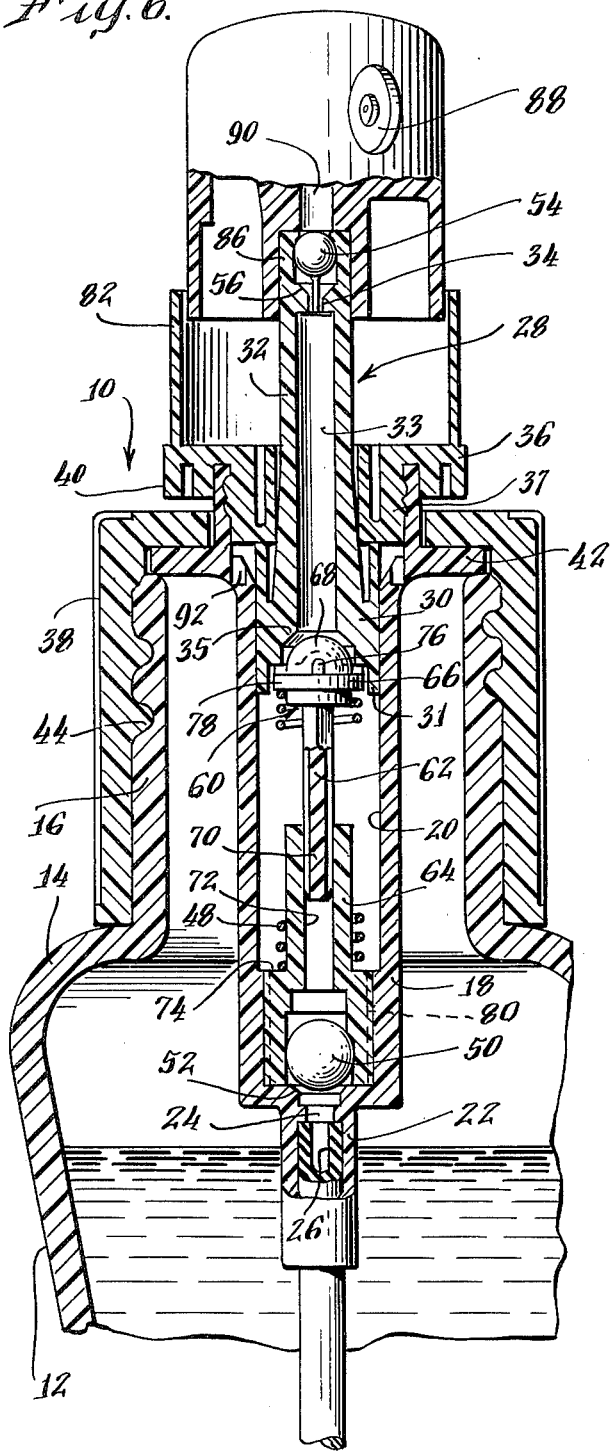
FIG. 6 is a vertical cross sectional view on the pump, similar to FIG. 2 but showing the plunger seal open and the pump in operative condition.
Figure 7:
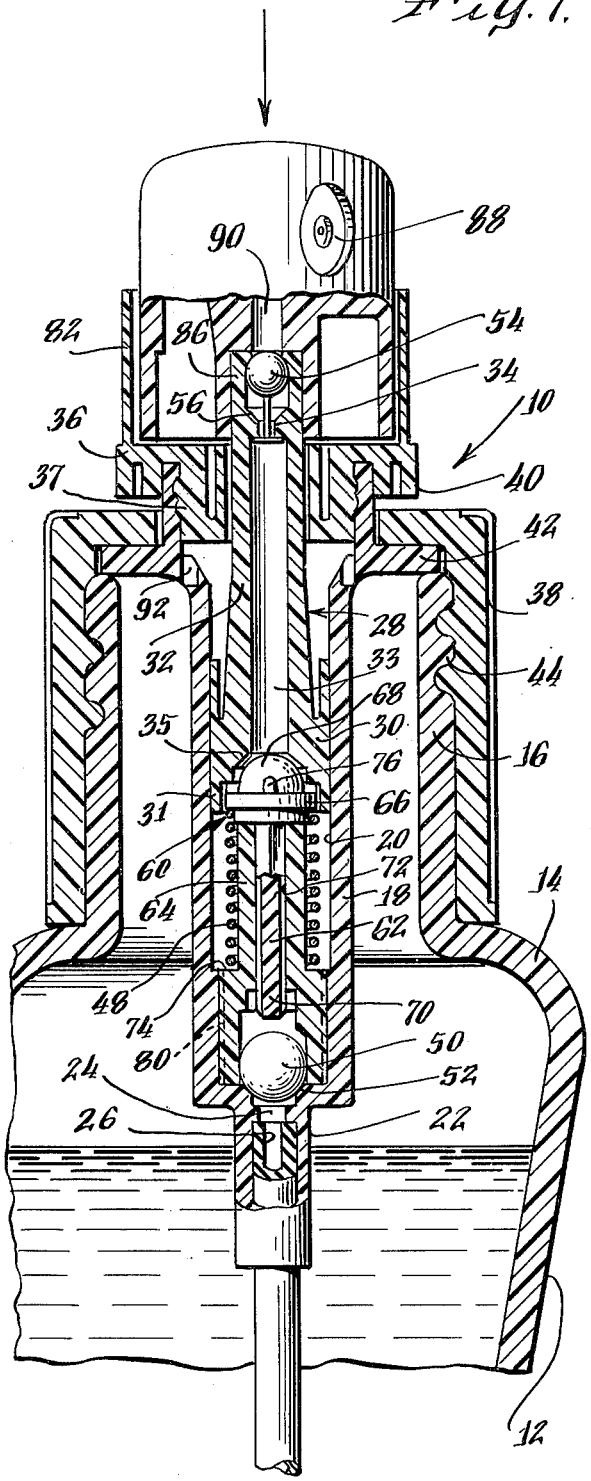
FIG. 7 is a view similar to FIG. 6 but with the pump plunger depressed.

The manner of operating the pump is readily apparent from the foregoing description, and as further illustrated in FIGS. 6 and 7. Assuming the pump is in locked condition, it is first unlocked by turning actuator button 84 and the associated piston rod 32 relative to housing 18. To facilitate this, both the actuator button periphery and the adjacent retainer wall periphery (and/or the cap wall periphery) may be axially ribbed or fluted to provide better finger purchase. A light clicking noise, produced by the snapping of nibs 76 into and out of recesses 78, gives audible indication to the user of locking or unlocking of the pump. When unlocked, successively depressing the plunger produces pumping action to draw liquid from the container and dispense it as a spray or stream through the discharge nozzle of the actuator button. Normal depression of the plunger is of course accomplished in this mode by the telescoping stem arrangement of the plunger seal assembly. In the locked position of the plunger seal, attempted depression of the plunger causes internal pressure to be developed in the pump chamber, which pressure effectively blocks further depression of the piston. Dispensing of fluid is blocked in any event by the interposition of the stopper in the outlet passage of the plunger.

Various modifications in the basic pump design are possible. For example, the range of travel of plunger assembly 28, and hence, the amount of liquid dispensed in a single pumping stroke may be adjusted by placing one or more spacer rings 94 about stem 70. When the plunger assembly 28 is depressed, these rings separate the stopper disc 66 and the upper portion of base member 64 to limit the plunger stroke by an amount equal to the ring thickness. This provides a simple way by which the pump manufacturer can alter the dispensing capacity of the pump to meet particular requirements of a customer without change in molding dies, etc.

Figure 8:
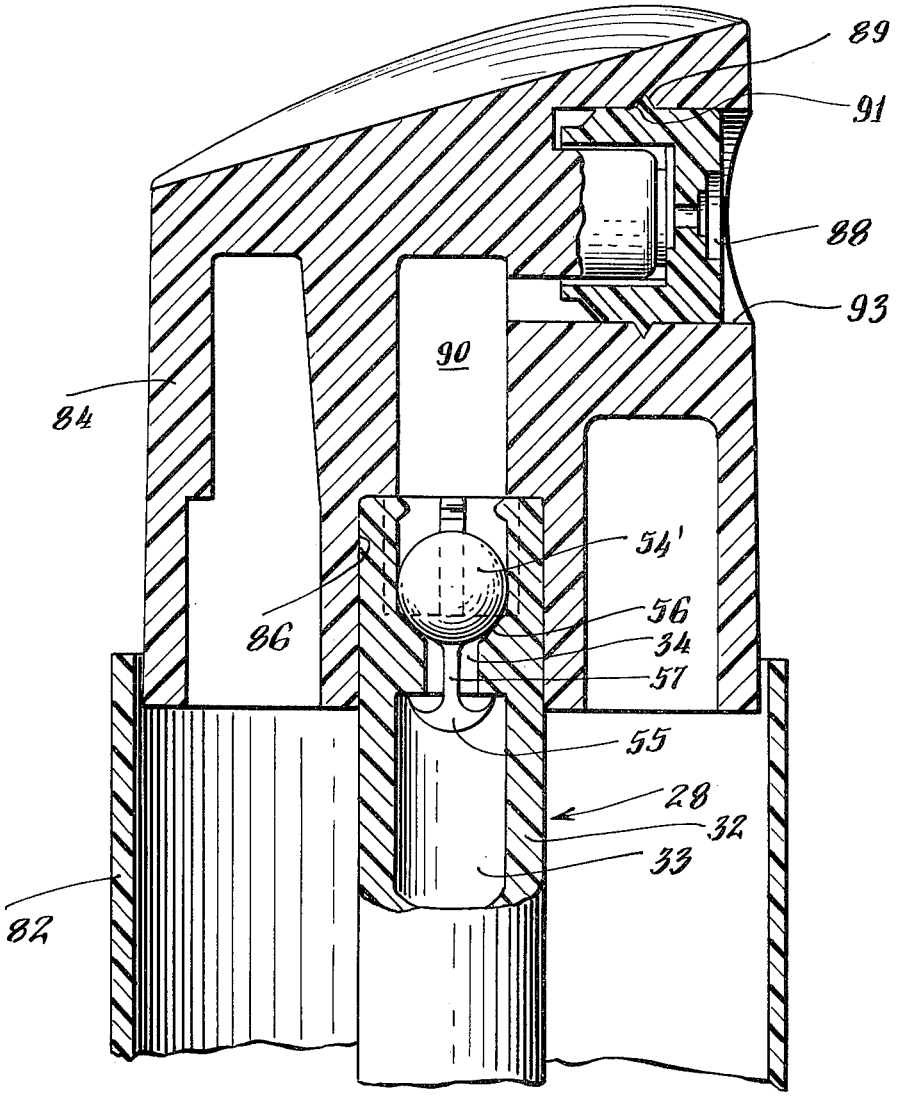
FIG. 8 is an enlarged vertical cross-sectional view of the nozzle and upper portion of the piston rod.

Other modifications are shown in FIG. 8. For example, the discharge check valve may be a molded ball 54' having an integrally connected mushroom-shaped elastomeric retainer 55. Retainer 55, which has a stem 57 that passes through outlet conduit 34, engages the lower lip of the conduit to retain the ball resiliently seated so that it will assist evaporation or leakage of fluid trapped between it and the stopper under non-dispensing conditions. As also illustrated in FIG. 8, nozzle 88 may be provided with a circumferential rib 89 that engages a similar circumferential groove 91 formed in a nozzle socket 93 in actuator button 84. When engaged, rib 89 and groove 91 prevent disengagement of nozzle 88 from socket 93 even under substantial pressures that may be developed by the pumping action.

What is claimed is:

1. In a finger operated plunger pump adapted for mounting in a container for dispensing liquid therefrom, wherein the pump includes a housing and mounting means for securing it in the mouth of the container, a pumping chamber defined by the housing and a hollow plunger telescopically received with a piston fit in the chamber for reciprocation therein and for rotation relative to said housing about the axis of said housing, said housing and plunger having inlet and outlet flow passages, respectively, and check valve means located therein to prevent return flow of liquid therethrough, the improvement in selectively operable seal means for disabling pump operation and preventing leakage through the pump during periods of non-use which comprises:

a valve seat formed about one of said inlet and outlet passages within said pump chamber, stopper means disposed in said chamber for cooperation with said valve seat to block the flow of liquid, said stopper means having a stem, and a base member within which said stem is telescopically received, one of said stopper means and valve seat being non-rotatively supported in said housing and the other in said plunger, whereby said stopper means and valve seat can be rotated relative to each other through rotation of said housing and plunger, means for urging at least a portion of said stopper means against said valve seat, and detent means on said stopper means and valve seat which are registrable in one rotated angular position of said stopper means and seat and non-registrable in another, said detent means producing a camming action on rotation of said stopper means and seat from the registrable to the non-registrable position to cause axial separation of said stopper means from said seat to unblock said flow passage.

2. The improvement in a finger operated plunger pump as defined in claim 1, wherein said detent means comprises:

at least one nib formed on one of said stopper means and said valve seat; and at least one mating depression formed on the other of said stopper means and said valve seat; said nib and mating depression being registrable in one rotated angular position of said stopper means and valve seat and non-registrable in another to cam said stopper means axially away from said valve seat on rotation of said stopper means and said valve seat.

3. The improvement in a finger operated plunger pump as defined in claim 1 wherein said stopper means further comprises:

a disc formed on said stem; and a dome-like protuberance formed on said disc to sealingly mate with said valve seat.

4. The improvement in a finger operated plunger pump as defined in claim 1 wherein said stopper means base member has a socket within which said stopper means stem is telescopically received, said socket and said stem being noncircular in cross section to substantially prevent relative rotational movement between them.

5. The improvement in a finger operated plunger pump as defined in claim 4 wherein said stem is cusped to provide liquid flow area between confronting faces of said socket and stem.

6. The improvement in a finger operated plunger pump as defined in claim 1 wherein said stopper means base member is nonrotatively supported in said housing, said base member having at least one rib accommodated by the wall of said housing to lock said base member against rotation therein.

7. The improvement in a finger operated plunger pump as defined in claim 1 further comprising:

impediment means for preventing inadvertent reregistration of said detent means after said stopper means has been cammed axially away from said valve seat.

8. The improvement in a finger operated plunger pump as defined in claim 7 wherein said detent means comprises:

at least one nib formed on one of said stopper means and said valve seat;

at least one mating depression formed on the other of said stopper means and said valve seat, said nib and mating depression being registrable in one rotated angular position of said stopper means and valve seat and nonregistrable in another to cam said stopper means axially away from said valve seat on rotation of said stopper means and said valve seat; and wherein said impediment means comprises at least one ridge flanking each side of said mating depression.

* * * * *